US008170257B2

(12) United States Patent
Chan

(10) Patent No.: US 8,170,257 B2
(45) Date of Patent: May 1, 2012

(54) APPARATUS FOR REDUCING BACKGROUND AND WIND NOISE TO A MICROPHONE

(76) Inventor: Wayne G P Chan, Santa Clara, CA (US)

( * ) Notice: Subject to any disclaimer, the term of this patent is extended or adjusted under 35 U.S.C. 154(b) by 901 days.

(21) Appl. No.: 12/201,612

(22) Filed: Aug. 29, 2008

(65) Prior Publication Data

US 2010/0054516 A1 Mar. 4, 2010

(51) Int. Cl.
*H04R 1/02* (2006.01)

(52) U.S. Cl. ..... 381/359; 381/189

(58) Field of Classification Search ..... 181/198, 181/199, 242; 381/189, 359, 360
See application file for complete search history.

(56) References Cited

U.S. PATENT DOCUMENTS 4,570,746 A * 2/1986 Das et al. ..... 381/359
4,966,252 A * 10/1990 Drever ..... 181/158
6,681,022 B1 * 1/2004 Puthuff et al. ..... 381/338
2001/0005179 A1 * 6/2001 Hutchison ..... 343/763
2005/0271233 A1 * 12/2005 Uchimura ..... 381/359
2007/0078346 A1 * 4/2007 Park et al. ..... 600/459

* cited by examiner

*Primary Examiner* — Michelle Mandala
*Assistant Examiner* — Raj R Gupta
(74) *Attorney, Agent, or Firm* — Invent Capture, LLC.; Samuel S. Cho

(57) ABSTRACT

An apparatus for reducing background and wind noise to a microphone contained in a microphone casing comprises a clamshell enclosure. The clamshell enclosure has a top piece and a bottom piece held together by a hinge or a plastic membrane, wherein the clamshell enclosure is designed to encapsulate the microphone casing containing the microphone. The clamshell enclosure contains foam materials inside the clamshell enclosure, or the clamshell enclosure itself is made out of foam materials such as polyurethane, wherein the foam materials contribute to reduction of background and wind noises to the microphone. The clamshell enclosure may optionally incorporate one or more channels as electrical cord pathways between the microphone casing encapsulated in the clamshell enclosure and another object (e.g. electronic device, earphones, and etc.).

18 Claims, 7 Drawing Sheets

100

900

APPARATUS FOR REDUCING BACKGROUND AND WIND NOISE TO A MICROPHONE

BACKGROUND OF THE INVENTION

The present invention generally relates to an electronic device using a microphone. More specifically, the invention relates to an apparatus for reducing background and wind noise to a microphone.

Many modern electronic devices incorporate voice communication capabilities. An example of a commoditized voice communication-capable electronic device is a cellular phone, which is often configured to function with an earphone and microphone combination device, defined herein as a "headphone". Because an electronic device incorporating voice communication capabilities (e.g. a cellular phone, a "smart phone" with personal computer or personal data assistant (PDA) capabilities, and etc.) is frequently configured to operate in a mobile environment, reducing background noise or wind noise undesirably feeding into its microphone is important in high-fidelity telecommunications.

A headphone incorporating a microphone and an earphone is commonly provided to a consumer as part of an original packaging for a voice communication-capable electronic device or is optionally purchasable in stores. For most headphones in the market today, plastic or metal windscreens are commonly used to achieve background and wind noise reduction. Sometimes, foam-based windscreen sponges are also used to make the background and wind noise reduction more effective. A conventional foam-based windscreen sponge typically uses an elastic hole on one side of the sponge to provide an entry and exit pathway for encapsulating a microphone casing containing a microphone. Therefore, the conventional foam-based windscreen sponge is usually ideal for a microphone casing with an electrical connection on only one side of the microphone casing.

If the microphone casing has electrical connections on two or more sides of the microphone casing, the conventional foam-based windscreen sponge with an elastic hole only on one side of the sponge typically cannot be used. Furthermore, even if the conventional foam-based windscreen sponge had geometrically-matching elastic holes to a microphone casing with multiple sides of electrical connections, it is difficult to provide a convenient encapsulation or removal of the sponge from the microphone. For example, because a wired "headphone" incorporating a wired microphone casing typically has at least two sides of electrical connections for the wired microphone casing, the wired microphone casing available in the market currently typically does not have a foam-based windscreen sponge on an exterior surface of the wired microphone casing.

Although some wired microphone casings with at least two sides of electrical connections still incorporate a wind screen or an internal windscreen sponge, the current trend of miniaturization of microphones and microphone casings in headphones for voice communication-capable electronic devices makes conventional wind screens or internal windscreens sponges difficult to incorporate, often resulting in a less-than-ideal background and wind noise reduction.

Accordingly, a novel apparatus designed to be used with numerous types of microphone casing configurations for background and wind noise reduction can provide significant advantages to headphones for voice communication-capable electronic devices.

SUMMARY

Summary and Abstract summarize some aspects of the present invention. Simplifications or omissions may have been made to avoid obscuring the purpose of the Summary or the Abstract. These simplifications or omissions are not intended to limit the scope of the present invention.

An apparatus for reducing background and wind noise to a microphone contained in a microphone casing is disclosed. The apparatus comprises a clamshell enclosure with a hinge on a first side of the clamshell enclosure, wherein the clamshell enclosure is configured to open and/or close to encapsulate the microphone casing, a first channel on the clamshell enclosure for accommodating a first electrical cord operatively connected to the microphone casing, wherein the microphone casing is placed inside the clamshell enclosure, and a second channel on the clamshell enclosure for accommodating a second electrical cord operatively connected to the microphone casing, wherein the microphone casing is placed inside the clamshell enclosure.

Furthermore, another apparatus for reducing background and wind noise to a microphone contained in a microphone casing is disclosed. The apparatus comprises a top piece of a clamshell enclosure with a plastic membrane attached to a first side of the top piece of the clamshell enclosure, a bottom piece of the clamshell enclosure with the plastic membrane attached to a first side of the bottom piece of the clamshell enclosure, wherein the clamshell enclosure is configured to open and/or close to encapsulate the microphone casing, a first channel on the clamshell enclosure for accommodating a first electrical cord operatively connected to the microphone casing, wherein the microphone casing is placed inside the clamshell enclosure, a second channel on the clamshell enclosure for accommodating a second electrical cord operatively connected to the microphone casing, wherein the microphone casing is placed inside the clamshell enclosure, and a snap-fit locking mechanism between the top piece and the bottom piece of the clamshell enclosure.

Moreover, another apparatus for reducing background and wind noise to a microphone contained in a microphone casing comprises a top piece of a clamshell enclosure, wherein a first side of the top piece of the clamshell enclosure is mostly or entirely straight, a bottom piece of the clamshell enclosure, wherein a first side of the bottom piece of the clamshell enclosure is mostly or entirely straight and wherein the clamshell enclosure is configured to open and/or close to encapsulate the microphone casing, a hinge or a plastic membrane connecting a second side of the top piece of the clamshell enclosure and a second side of the bottom piece of the clamshell enclosure, a first electrical cord operatively connected to a top portion of the microphone casing, wherein the microphone casing is placed inside the clamshell enclosure, and a second electrical cord operatively connected to a bottom portion of the microphone casing, wherein the microphone casing is placed inside the clamshell enclosure.

DETAILED DESCRIPTION

Figure 1:
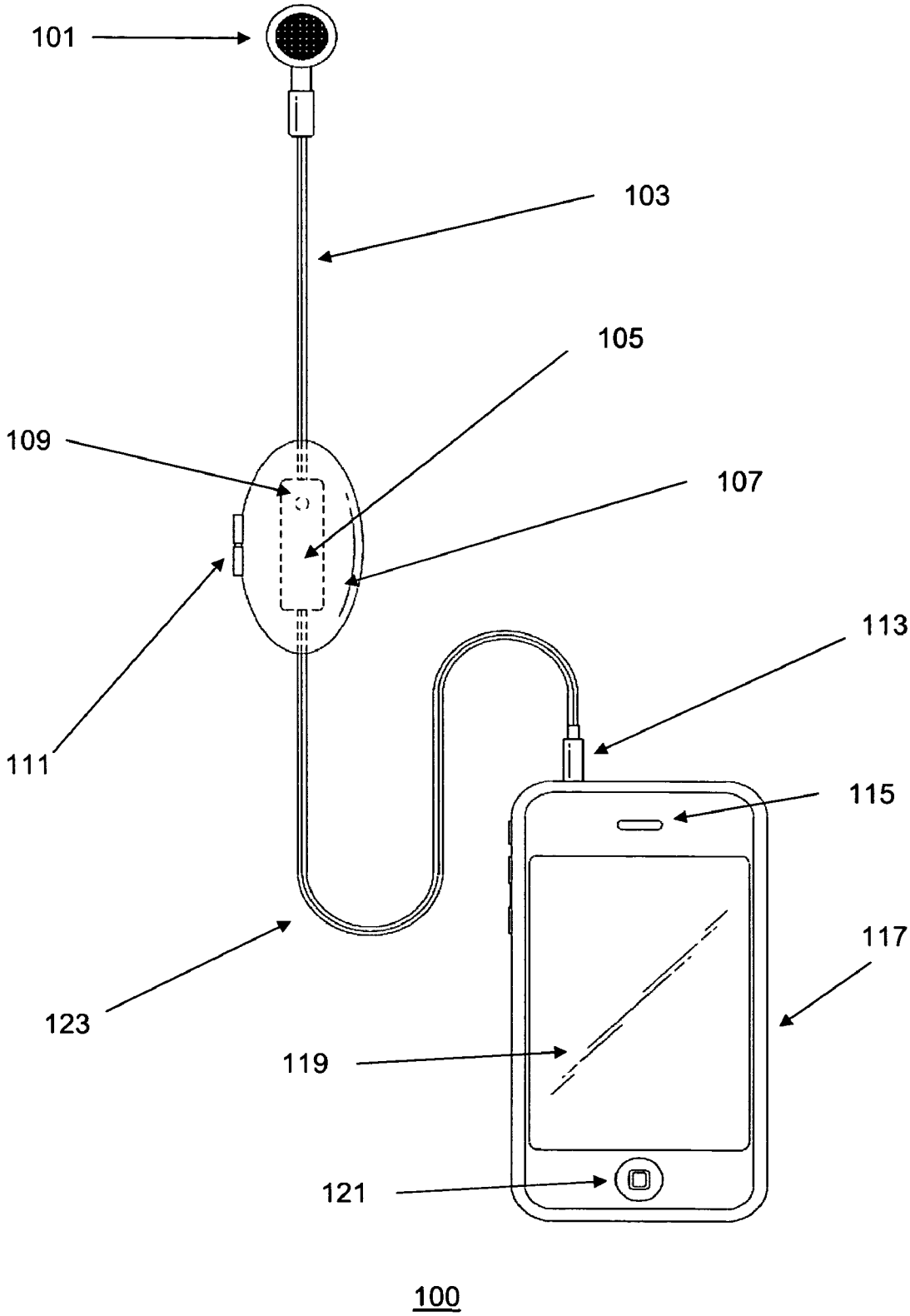
FIG. 1 shows a transparent view of a clamshell enclosure encapsulating a microphone casing, wherein the microphone casing is operatively connected to an earphone and an electronic device in accordance with an embodiment of the present invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

The detailed description is presented largely in terms of description of shapes, configurations, and/or other symbolic representations that directly or indirectly resemble an apparatus for reducing background and wind noise to a microphone. These process descriptions and representations are the means used by those experienced or skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment. Furthermore, separate or alternative embodiments are not necessarily mutually exclusive of other embodiments. Moreover, the order of blocks in process flowcharts or diagrams representing one or more embodiments of the invention do not inherently indicate any particular order nor imply any limitations in the invention.

Figure 6:
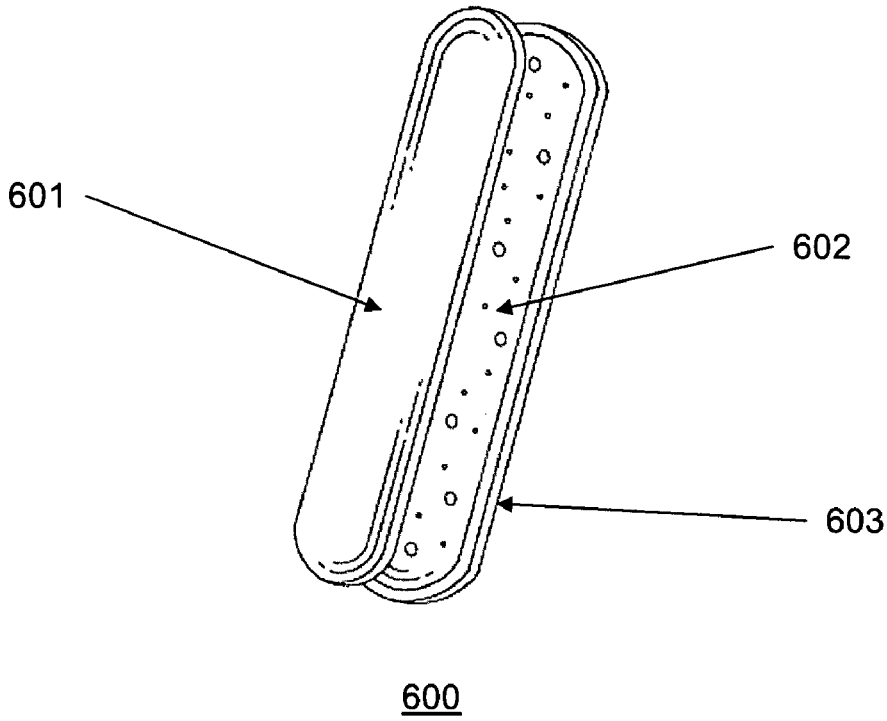
FIG. 6 shows a detailed half-open state view of a clamshell enclosure with mostly or entirely straight sides, wherein the clamshell enclosure is configured to encapsulate a microphone casing in accordance with an embodiment of the present invention.
Figure 7:
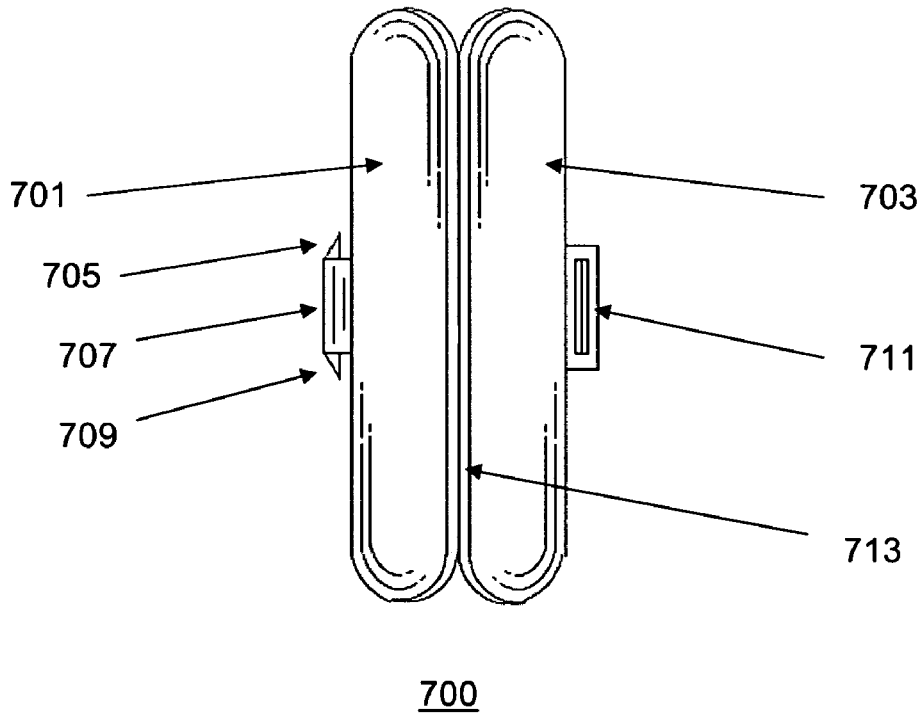
FIG. 7 shows a detailed open-state view of a clamshell enclosure with mostly or entirely straight sides, wherein the clamshell enclosure is configured to encapsulate a microphone casing in accordance with an embodiment of the present invention.
Figure 8:
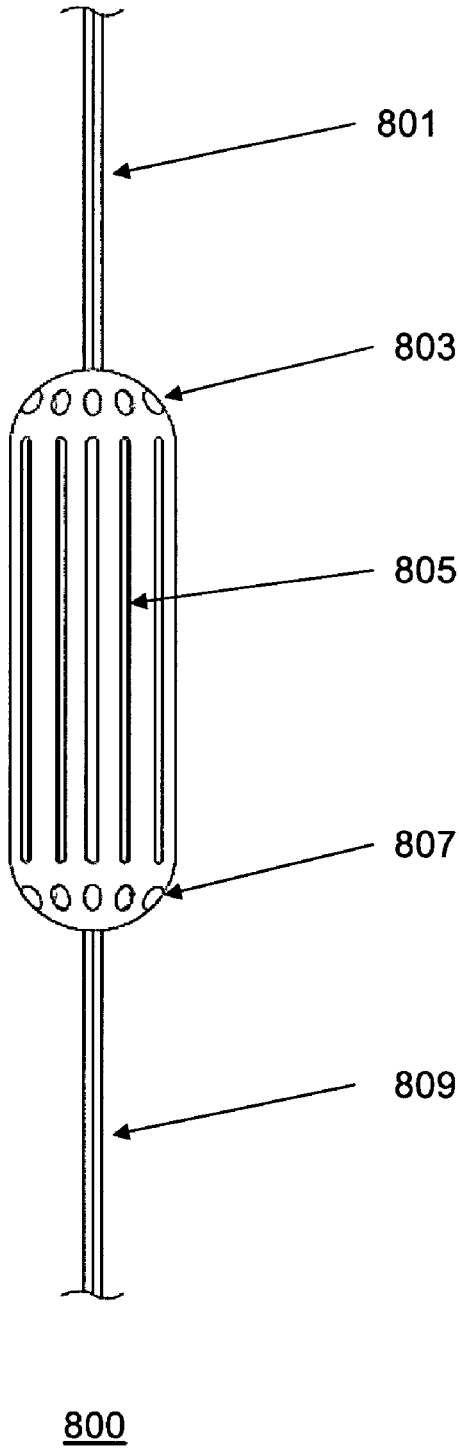
FIG. 8 shows a detailed closed-state view of a clamshell enclosure with interior foam and exterior sound vents and/or sound holes in accordance with an embodiment of the present invention.
Figure 9:
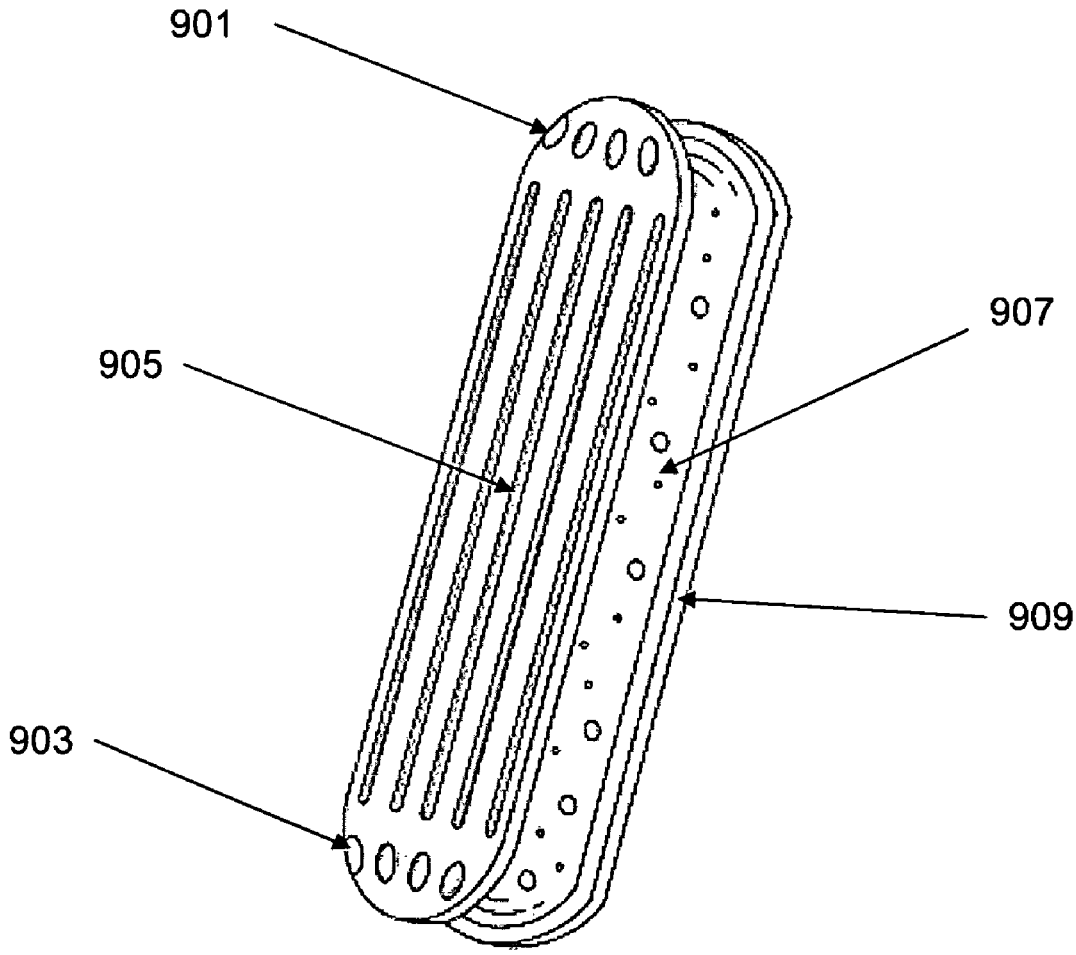
FIG. 9 shows a detailed half-open-state view of a clamshell enclosure with interior foam and exterior sound vents and/or sound holes in accordance with an embodiment of the present invention.

For the purpose of describing the invention, a term "clamshell enclosure" is defined as a solid two-piece enclosure, wherein the clamshell enclosure comprises a top piece and a bottom piece typically attached together by a hinge or a plastic membrane. The shape of the clamshell enclosure can vary greatly. One example of a clamshell enclosure in accordance with the present invention is oval-shape top and bottom pieces, as depicted in FIGS. 1~5. Another example of a clamshell enclosure in accordance with the present invention is hotdog-shape top and bottom pieces, as depicted in FIGS. 6~7. Yet another example of a clamshell enclosure in accordance with the present invention is hotdog-shape top and bottom pieces with sound holes and/or vents, as depicted in FIGS. 8~9. The examples portrayed by aforementioned figures are merely illustrative of a few embodiments of some clamshell enclosures in accordance with the present invention and do not limit the present invention to these particular shapes.

Furthermore, for the purpose of describing the invention, a term "channel" is defined as an indented electrical cord pathway on a clamshell enclosure for accommodating an electrical cord operatively connected to a microphone casing.

In addition, for the purpose of describing the invention, a term "plastic membrane" is defined as a plastic piece attaching a top piece and a bottom piece of a clamshell enclosure.

Moreover, for the purpose of describing the invention, a term "headphone" is defined as an earphone and microphone combination device used for voice communication and sound reproduction.

For voice communication-capable electronic devices in the market today, headphones are typically available as part of original packaging or optionally purchasable in stores. Most headphones use plastic or metal windscreens, and in some cases, foam-based windscreen sponges are used to achieve background and wind noise reduction. A conventional foam-based windscreen sponge typically uses an elastic hole on one side of the sponge to provide an entry and exit pathway for encapsulating a microphone casing containing a microphone. Therefore, the conventional foam-based windscreen sponge is usually ideal for a microphone casing with an electrical connection on only one side of the microphone casing.

However, a microphone casing which has electrical connections on two or more sides of the microphone casing is typical for a wired headphone used for a mobile phone device. The microphone casing with electrical connections on two or more sides of the microphone casing cannot use a conventional foam-based windscreen sponge with an elastic hole typically only on one side of the sponge. Furthermore, even if the conventional foam-based windscreen sponge had geometrically-matching elastic holes to a microphone casing with multiple sides of electrical connections, it is difficult to provide a convenient encapsulation or removal of the sponge from the microphone casing. For example, because a wired "headphone" incorporating a wired microphone casing typically has at least two sides of electrical connections for the wired microphone casing, the wired microphone casing available in the market currently typically does not have a foam-based windscreen sponge on an exterior surface of the wired microphone casing.

Although some wired microphone casings with at least two sides of electrical connections still incorporate a wind screen or an internal windscreen sponge, the current trend of miniaturization of microphones in headphones for voice communication-capable electronic devices make conventional wind screens or internal windscreens sponges difficult to incorporate, often resulting in a less-than-ideal background and wind noise reduction.

Accordingly, a novel clamshell enclosure encapsulating a microphone casing containing a microphone is disclosed as an apparatus for reducing background and wind noise. One objective of the present invention is achieving more effective reduction of background and wind noise using the novel clamshell enclosure, compared to existing microphone windscreens used in typical headphones. Another objective of the present invention is achieving an ease of encapsulation of a microphone casing using the novel clamshell enclosure, especially when the microphone casing has more than one side of electrical connections. Yet another objective of the present invention is accommodating a button-press feature (e.g. "Connect Call" or "Disconnect Call" button on a microphone) by optionally using a malleable material for the novel clamshell enclosure. Yet another objective of the present invention is realizing a fashion-accessory potential of a clamshell enclosure, wherein the clamshell enclosure can use embroidered or printed graphics, possibly in combination with a distinct shape of the clamshell closure, to make a user's fashion statement or endorsement (e.g. a sports team, a brand logo, a political party, a national flag, and etc.).

FIG. 1 shows a transparent view (100) of a clamshell enclosure (107) encapsulating a microphone casing (105), wherein the microphone casing (105) contains a microphone (109) and is operatively connected to an earphone (101) and an electronic device (117) in accordance with an embodiment of the present invention. In one embodiment of the invention, the clamshell enclosure (107) has a hinge (111) to open or close a top piece and a bottom piece of the clamshell enclosure (107). In one embodiment of the invention, the hinge (111) is a spring hinge. As shown in FIG. 1, the hinge (111) may be visible from an outer surface of the clamshell enclosure (107) in one embodiment of the invention. In another embodiment of the invention, the hinge (111) is internally attached to the top piece and the bottom piece of the clamshell enclosure (107) and therefore the hinge (111) may be largely invisible from the outer surface of the clamshell enclosure.

In one embodiment of the invention, the clamshell enclosure (107) is made of a flexible or malleable plastic material. If the clamshell enclosure (107) is made of the flexible or malleable plastic material, the clamshell enclosure (107) can be pushed or squeezed to trigger a button-press on a microphone casing. For example, an Apple iphone headphone has a "squeezable" microphone casing (e.g. 105) which acts as a "Connect Call" or "Disconnect Call" button. In another embodiment of the invention, the clamshell enclosure (107) is made of foam such as polyurethane. Because foam materials, including polyurethane, are also malleable materials, they can also be pushed or squeezed to trigger a button-press on a microphone casing (e.g. 105). Yet in another embodiment of the invention, the clamshell enclosure (107) is made of a hard material such as aluminum or metal composites.

Continuing with FIG. 1, the microphone casing (105) is operatively connected to the earphone (101) using a first electrical cord (103). The microphone casing (105) is also operatively connected to the electronic device (117) using a second electrical cord (123). The second electrical cord typically uses an input jack (113) to connect to the electronic device (117). In a preferred embodiment of the invention, the electronic device (117) is a voice-capable electronic device such as a cellular phone which may also have music-playing capabilities, computer-related task capabilities, and other features. The electronic device (117) as shown in FIG. 1 has an earpiece speaker (115), a functional button (121), and a touch-screen display (119). It should be noted that the electronic device (117) as shown in FIG. 1 is merely one example of an electronic device that can be used in conjunction with the clamshell enclosure (107). Therefore, a particular configuration or features related to an electronic device (e.g. 117) connected to the microphone casing (105) does not limit the present invention in any way or form.

Figure 2:
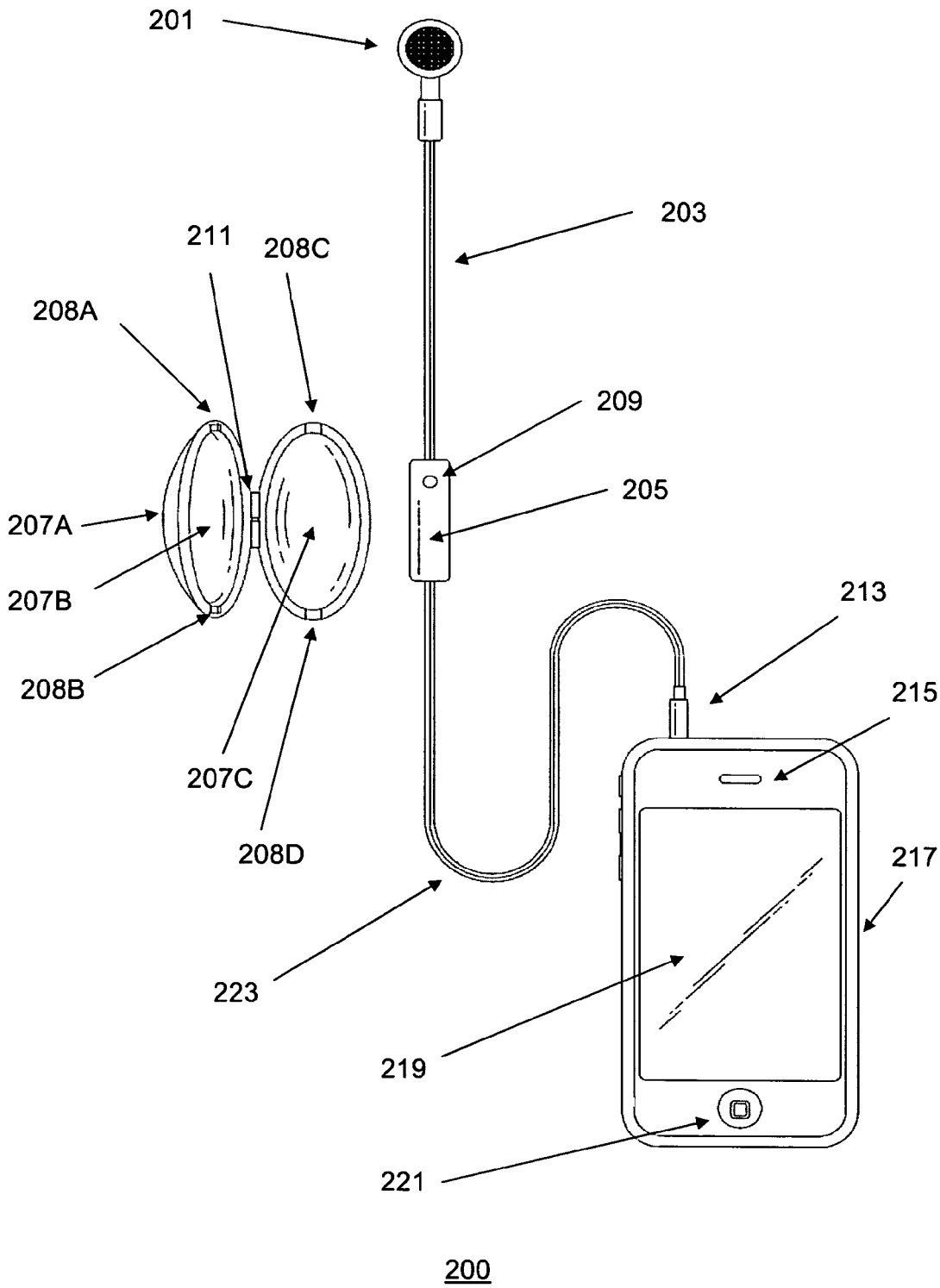
FIG. 2 shows an open-state view of a clamshell enclosure next to a microphone casing, wherein the microphone casing is operatively connected to an earphone and an electronic device in accordance with an embodiment of the present invention.

FIG. 2 shows an open-state view (200) of a clamshell enclosure (207A, 207B, 207C) next to a microphone casing (205) containing a microphone (209), wherein the microphone casing (205) is operatively connected to an earphone (201) and an electronic device (217) in accordance with an embodiment of the present invention.

In one embodiment of the invention, the clamshell enclosure (207A, 207B, 207C) has a hinge (211) to open or close a top piece (207A, 207B) and a bottom piece (207C) of the clamshell enclosure (207A, 207B, 207C). In one embodiment of the invention, the hinge (211) is a spring hinge. As shown in FIG. 2, the hinge (211) may be visible from an outer surface (e.g. 207A) of the clamshell enclosure (207A, 207B, 207C) in one embodiment of the invention. In another embodiment of the invention, the hinge (211) is internally attached to an inner surface (e.g. 207B, 207C) of the top piece (207A, 207B) and the bottom piece (207C) of the clamshell enclosure (207A, 207B, 207C) and therefore the hinge (211) may be largely invisible from the outer surface (e.g. 207A) of the clamshell enclosure.

As shown in FIG. 2, the inner surface (e.g. 207B, 207C) of the clamshell enclosure (207A, 207B, 207C) is designed to contain and encapsulate the microphone casing (205). In one embodiment of the invention, the inner surface (e.g. 207B, 207C) of the clamshell enclosure (207A, 207B, 207C) contains foam materials (e.g. polyurethane) to reduce background and wind noise transmitted to the microphone (209). In another embodiment of the invention, the clamshell enclosure itself (207A, 207B, 207C) is made of foam materials (e.g. polyurethane) to reduce background and wind noise transmitted to the microphone (209). Furthermore, the inner surface (e.g. 207B, 207C) of the clamshell enclosure (207A, 207B, 207C) can utilize a preconfigured molding to fit a particular shape of a microphone casing (e.g. 205) and/or electrical cords (e.g. 203, 223) tightly. For example, as shown in FIG. 2, a plurality of "channels" (208A, 208B, 208C, 208D) is indented into the top piece (207A, 207B) and the bottom piece (207C) of the clamshell enclosure (207A, 207B, 207C) as indented electrical cord pathways for a first electrical cord (203) and a second electrical cord (223).

In one embodiment of the invention, the clamshell enclosure (207A, 207B, 207C) is made of a flexible or malleable plastic material. If the clamshell enclosure (207A, 207B, 207C) is made of the flexible or malleable plastic material, the clamshell enclosure (207A, 207B, 207C) can be pushed or squeezed to trigger a button-press on a microphone casing. For example, an Apple iphone headphone has a "squeezable" microphone casing (e.g. 205) which acts as a "Connect Call" or "Disconnect Call" button. In another embodiment of the invention, the clamshell enclosure (207A, 207B, 207C) is made of foam such as polyurethane. Because foam materials, including polyurethane, are also malleable materials, they can also be pushed or squeezed to trigger a button-press on a microphone casing (e.g. 205). Yet in another embodiment of the invention, the clamshell enclosure (207A, 207B, 207C) is made of a hard material such as aluminum or metal composites.

Continuing with FIG. 2, the microphone casing (205) is operatively connected to the earphone (201) using the first electrical cord (203). The microphone casing (205) is also operatively connected to the electronic device (217) using a second electrical cord (223). The second electrical cord typically uses an input jack (213) to connect to the electronic device (217). In a preferred embodiment of the invention, the electronic device (217) is a voice-capable electronic device such as a cellular phone which may also have music-playing capabilities, computer-related task capabilities, and other features. The electronic device (217) as shown in FIG. 2 has an earpiece speaker (215), a functional button (221), and a touch-screen display (219). It should be noted that the electronic device (217) as shown in FIG. 2 is merely one example of an electronic device that can be used in conjunction with the clamshell enclosure (207A, 207B, 207C). Therefore, a particular configuration or features related to an electronic device (e.g. 217) connected to the microphone casing (205) does not limit the present invention in any way or form.

Figure 3:
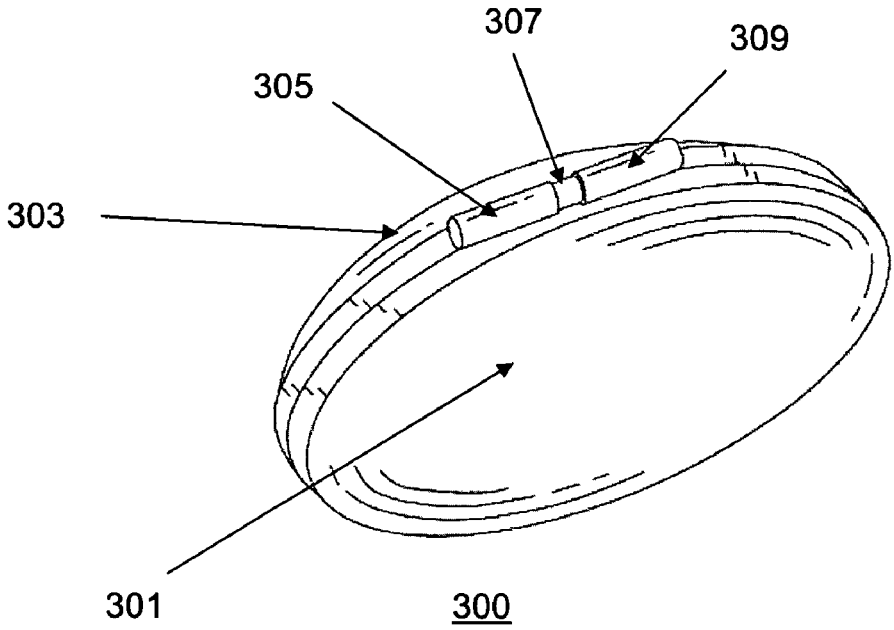
FIG. 3 shows a detailed closed-state view of a clamshell enclosure configured to encapsulate a microphone casing for reducing background and wind noise in accordance with an embodiment of the present invention.

FIG. 3 shows a detailed closed-state view of a clamshell enclosure (300) configured to encapsulate a microphone casing for reducing background and wind noise in accordance with an embodiment of the present invention. As shown in FIG. 3, a top piece (301) and a bottom piece (303) of the clamshell enclosure (300) is held together by a hinge (305, 307, 309). In one embodiment of the invention, the hinge (305, 307, 309) comprises a connecting rod (307) and two rod holders (305, 309). In one embodiment of the invention, the hinge (305, 307, 309) further comprises a spring mechanism to define a secure open position and a secure close position without requiring a snap-fit locking mechanism. In one embodiment of the invention, the hinge (305, 307, 309) may be designed to be visible from exterior surfaces (e.g. 301, 303) of the clamshell enclosure (300), as shown in FIG. 3. In another embodiment of the invention, the hinge (305, 307, 309) may be designed to be placed inside the clamshell enclosure (300) and therefore largely invisible from exterior surfaces (e.g. 301, 303) of the clamshell enclosure (300).

Furthermore, in one embodiment of the invention, the clamshell enclosure (300) utilizes a hinge-less design, wherein the clamshell enclosure (300) is held together by a plastic membrane. If the clamshell enclosure (300) is designed to be held together by the plastic membrane, a snap-fit locking mechanism is typically required to define a secure close position. One example of the snap-fit locking mechanism is a closure latch and/or a closure latch hook on the top piece (301) and/or the bottom piece (303) of the clamshell enclosure (300). Another example of the snap-fit locking mechanism is a female guide piece and/or a male guide piece on the top piece (301) and/or the bottom piece (303) of the clamshell enclosure (300).

Furthermore, in one embodiment of the invention, the exterior surfaces (e.g. 301, 303) of the clamshell enclosure (300) are imprinted or embroidered with graphics, pictures, texts, and/or logos, possibly in combination with a distinct shape of the clamshell enclosure (300), to make a user's fashion statement or endorsement (e.g. a sports team, a brand logo, a political party, a national flag, and etc.). It should be noted that the shape of the clamshell enclosure (300) is not limited to an oval shape (as shown in FIGS. 1~5) or a hotdog shape (as shown in FIGS. 6~9). For example, a squarely, triangular, corporate or team logo, or any other shapes are possible for the clamshell enclosure (300) as long as the clamshell enclosure (300) has a top piece and a bottom piece held by a hinge, a plastic membrane, or any other clamshell attachment methods.

In addition, the clamshell enclosure (300) may optionally incorporate one or more channels as electrical cord pathways between a microphone casing encapsulated in the clamshell enclosure (300) and another object (e.g. electronic device, earphones, and etc.), as previously shown in FIG. 2.

Figure 4:
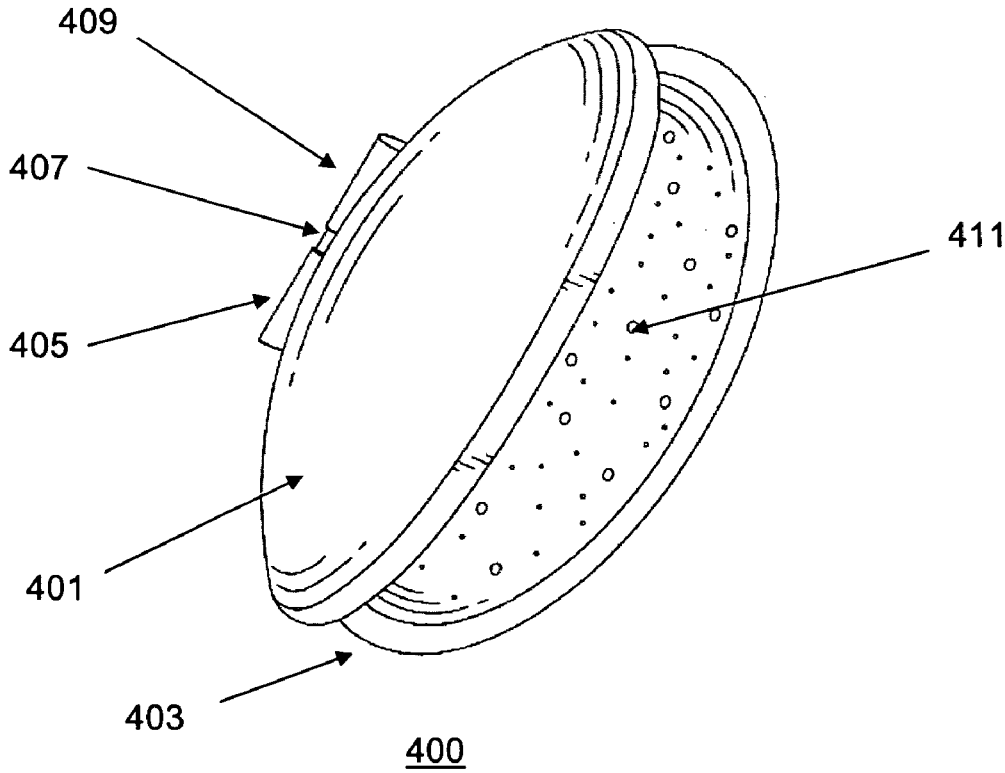
FIG. 4 shows a detailed half-open-state view of a clamshell enclosure configured to encapsulate a microphone casing for reducing background and wind noise in accordance with an embodiment of the present invention.

FIG. 4 shows a detailed half-open-state view of a clamshell enclosure (400) configured to encapsulate a microphone casing for reducing background and wind noise in accordance with an embodiment of the present invention. As shown in FIG. 4, a top piece (401) and a bottom piece (403) of the clamshell enclosure (400) is held together by a hinge (405, 407, 409). In one embodiment of the invention, the hinge (405, 407, 409) comprises a connecting rod (407) and two rod holders (405, 409). In one embodiment of the invention, the hinge (405, 407, 409) further comprises a spring mechanism to define a secure open position and a secure close position without requiring a snap-fit locking mechanism. In one embodiment of the invention, the hinge (405, 407, 409) may be designed to be visible from exterior surfaces (e.g. 401, 403) of the clamshell enclosure (400), as shown in FIG. 4. In another embodiment of the invention, the hinge (405, 407, 409) may be designed to be placed inside the clamshell enclosure (400) and therefore largely invisible from exterior surfaces (e.g. 401, 403) of the clamshell enclosure (400).

Furthermore, in one embodiment of the invention, the clamshell enclosure (400) utilizes a hinge-less design, wherein the clamshell enclosure (400) is held together by a plastic membrane. If the clamshell enclosure (400) is designed to be held together by the plastic membrane, a snap-fit locking mechanism is typically required to define a secure close position. One example of the snap-fit locking mechanism is a closure latch and/or a closure latch hook on the top piece (401) and/or the bottom piece (403) of the clamshell enclosure (400). Another example of the snap-fit locking mechanism is a female guide piece and/or a male guide piece on the top piece (401) and/or the bottom piece (403) of the clamshell enclosure (400).

Continuing with FIG. 4, in one embodiment of the invention, an interior surface (e.g. 411) of the clamshell enclosure (400) is covered with foam materials such as polyurethane. The exterior surfaces (e.g. 401, 403) of the clamshell enclosure (400) may be made of plastic, metallic, or other solid materials in this embodiment of the invention. The foam materials contribute to background and wind noise reduction by the clamshell enclosure (400). In another embodiment of the invention, the clamshell enclosure (400) itself is made out of foam materials such as polyurethane for simplicity of design and manufacturing cost savings.

Furthermore, in one embodiment of the invention, the exterior surfaces (e.g. 401, 403) of the clamshell enclosure (400) are imprinted or embroidered with graphics, pictures, texts, and/or logos, possibly in combination with a distinct shape of the clamshell enclosure (400), to make a user's fashion statement or endorsement (e.g. a sports team, a brand logo, a political party, a national flag, and etc.). It should be noted that the shape of the clamshell enclosure (400) is not limited to an oval shape (as shown in FIGS. 1~5) or a hotdog shape (as shown in FIGS. 6~9). For example, a squarely, triangular, corporate or team logo, or any other shapes are possible for the clamshell enclosure (400) as long as the clamshell enclosure (400) has a top piece and a bottom piece held by a hinge, a plastic membrane, or any other clamshell attachment methods.

In addition, the clamshell enclosure (400) may optionally incorporate one or more channels as electrical cord pathways between a microphone casing encapsulated in the clamshell enclosure (400) and another object (e.g. electronic device, earphones, and etc.), as previously shown in FIG. 2.

Figure 5:
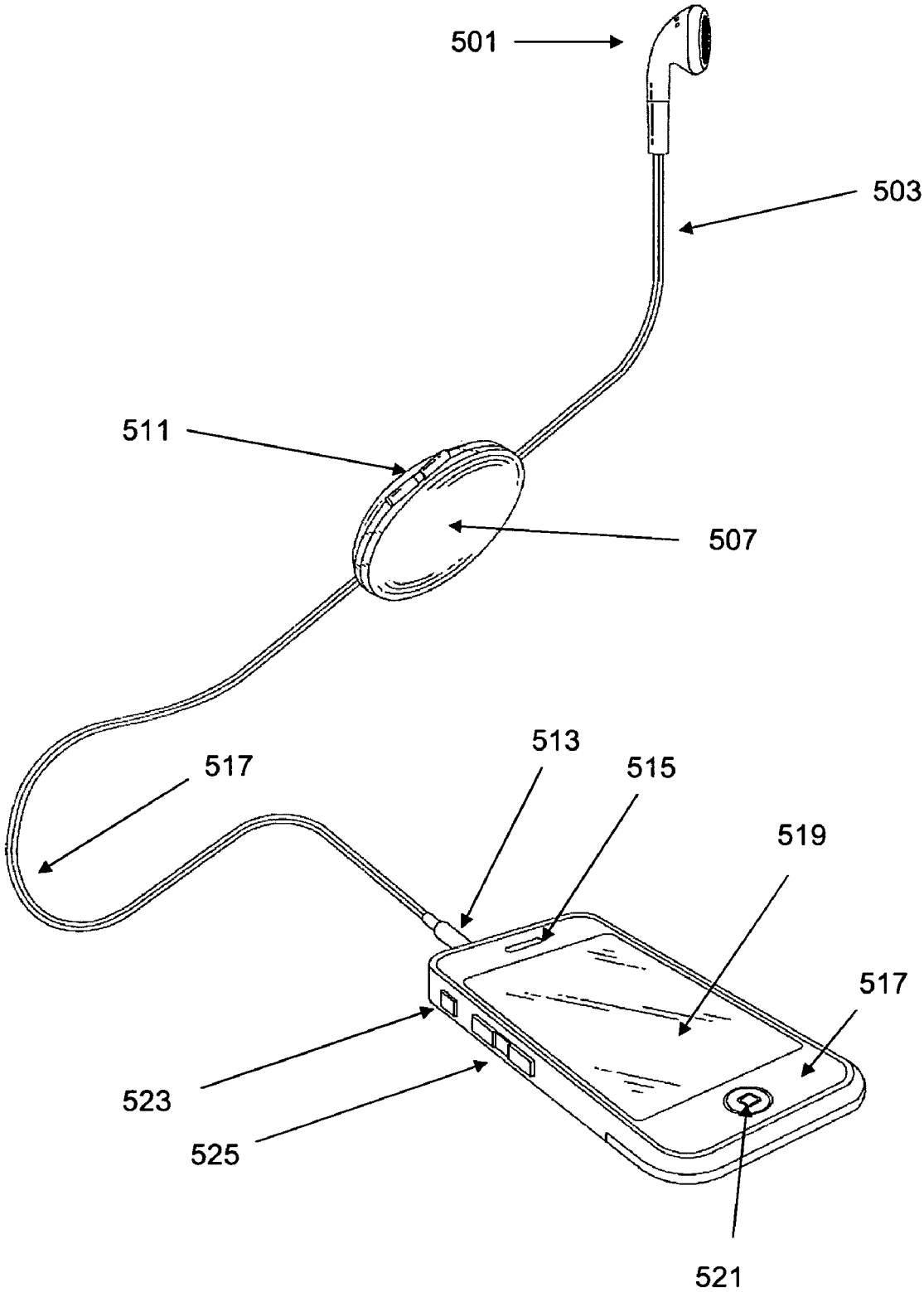
FIG. 5 shows a closed-state view of a clamshell enclosure encapsulating a microphone casing, wherein the microphone casing is operatively connected to an earphone and an electronic device in accordance with an embodiment of the present invention.

FIG. 5 shows a closed-state view (500) of a clamshell enclosure (507) encapsulating a microphone casing, wherein the microphone casing is operatively connected to an earphone (501) and an electronic device (517) in accordance with an embodiment of the present invention. In one embodiment of the invention, the clamshell enclosure (507) has a hinge (511) to open or close a top piece and a bottom piece of the clamshell enclosure (507). In one embodiment of the invention, the hinge (511) is a spring hinge. As shown in FIG. 5, the hinge (511) may be visible from an outer surface of the clamshell enclosure (507) in one embodiment of the invention. In another embodiment of the invention, the hinge (511) is internally attached to the top piece and the bottom piece of the clamshell enclosure (507) and therefore the hinge (511) may be largely invisible from the outer surface of the clamshell enclosure.

In one embodiment of the invention, the clamshell enclosure (507) is made of a flexible or malleable plastic material. If the clamshell enclosure (507) is made of the flexible or malleable plastic material, the clamshell enclosure (507) can be pushed or squeezed to trigger a button-press on a microphone casing. For example, an Apple iphone headphone has a "squeezable" microphone casing (e.g. 105 of FIG. 1) which acts as a "Connect Call" or "Disconnect Call" button. In another embodiment of the invention, the clamshell enclosure (507) is made of foam such as polyurethane. Because foam materials, including polyurethane, are also malleable materials, they can also be pushed or squeezed to trigger a button-press on a microphone casing (e.g. 105 of FIG. 1). Yet in another embodiment of the invention, the clamshell enclosure (507) is made of a hard material such as aluminum or metal composites.

Continuing with FIG. 5, the microphone casing (e.g. 105 of FIG. 1) encapsulated inside the clamshell enclosure (507) is operatively connected to the earphone (501) using a first electrical cord (503). The microphone casing (e.g. 105 of FIG. 1) is also operatively connected to the electronic device (517) using a second electrical cord (517). The second electrical cord (517) typically uses an input jack (513) to connect to the electronic device (517). In a preferred embodiment of the invention, the electronic device (517) is a voice-capable electronic device such as a cellular phone which may also have music-playing capabilities, computer-related task capabilities, and other features. The electronic device (517) as shown in FIG. 5 has an earpiece speaker (515), a functional button (521), and a touch-screen display (519). The electronic device (517) also has side buttons (523, 525) for controlling some features of the electronic device (517). It should be noted that the electronic device (517) as shown in FIG. 5 is merely one example of an electronic device that can be used in conjunction with the clamshell enclosure (507). Therefore, a particular configuration or features related to an electronic device (e.g. 517) connected to the microphone casing (e.g. 105 of FIG. 1) encapsulated by the clamshell enclosure (507) does not limit the present invention in any way or form.

FIG. 6 shows a detailed half-open state view of a clamshell enclosure (600) with mostly or entirely straight sides, wherein the clamshell enclosure (600) is configured to encapsulate a microphone casing in accordance with an embodiment of the present invention. In a preferred embodiment of the invention as shown by FIG. 6 (i.e. "best mode" of the invention as perceived by the inventor), the clamshell enclosure (600) has a hot-dog shape, with mostly or entirely straight sides. In the preferred embodiment of the invention, a top piece (601) and a bottom piece (603) of the clamshell enclosure (600) is held together by a hinge. In one embodiment of the invention, the hinge used for holding the top piece (601) and the bottom piece (603) of the clamshell enclosure (600) is a spring hinge with a defined secure close position and a defined secure open position. In another embodiment of the invention, the top piece (601) and the bottom piece (603) of the clamshell enclosure (600) is held together by a plastic membrane.

Furthermore, in one embodiment of the invention, the clamshell enclosure (600) in hot-dog shape is made out of metallic, plastic, or other solid materials with foam materials (602) inside the clamshell enclosure (600), wherein the foam materials (602) contribute to a reduction in background and wind noise to a microphone encapsulated by the clamshell enclosure (600) in a closed position. One example of foam materials (602) is polyurethane. In another embodiment of the invention, the clamshell enclosure (600) itself is made out of foam materials (e.g. 602) such as polyurethane for simplicity of design and manufacturing cost savings.

In addition, the clamshell enclosure (600) may optionally incorporate one or more channels as electrical cord pathways between a microphone casing encapsulated in the clamshell enclosure (600) and another object (e.g. electronic device, earphones, and etc.), as previously shown in FIG. 2.

FIG. 7 shows a detailed open-state view of a clamshell enclosure (700) with mostly or entirely straight sides, wherein the clamshell enclosure (700) is configured to encapsulate a microphone casing in accordance with an embodiment of the present invention. In a preferred embodiment of the invention as shown by FIG. 7 (i.e. a "best mode" of the invention as perceived by the inventor), the clamshell enclosure (700) has a hot-dog shape, with mostly or entirely straight sides. In one embodiment of the invention, a top piece (701) and a bottom piece (703) of the clamshell enclosure (700) is held together by a plastic membrane (713). When the top piece (701) and the bottom piece (703) of the clamshell enclosure (700) is in a closed position, the closed position can be secured by using a snap-fit locking mechanism (e.g. 705, 707, 709, 711). In one embodiment of the invention, the snap-fit locking mechanism (e.g. 705, 707, 709, 711) comprises a female guide (e.g. 711) and a male guide (e.g. 705, 707, 709) on the top piece (701) and/or the bottom piece (703) of the clamshell enclosure (700). In another embodiment of the invention, the snap-fit locking mechanism (e.g. 705, 707, 709, 711) comprises a closure latch (e.g. 711) and a closure latch hook (e.g. 705, 707, 709), wherein the closure latch (e.g. 711) may be bendable for snapping the closure latch hook (e.g. 705, 707, 709) into the closure latch (e.g. 711).

In addition, the clamshell enclosure (700) may optionally incorporate one or more channels as electrical cord pathways between a microphone casing encapsulated in the clamshell enclosure (700) and another object (e.g. electronic device, earphones, and etc.), as previously shown in FIG. 2.

FIG. 8 shows a detailed closed-state view of a clamshell enclosure (800) with interior foam and exterior sound vents (e.g. 805) and/or sound holes (e.g. 803, 807) in accordance with an embodiment of the present invention. In one embodiment of the invention, the clamshell enclosure (800) is made of flexible or malleable materials such as non-rigid plastic. If a microphone casing encapsulated inside the clamshell enclosure (800) has a squeezable button for features such as call connections or call disconnections, then flexible or malleable nature of the clamshell enclosure (800) enables a user to squeeze the clamshell enclosure (800) to trigger the squeezable button.

Furthermore, in one embodiment of the invention, the clamshell enclosure (800) has interior foam (e.g. polyurethane) inside to reduce background and wind noise entering a microphone contained by the microphone casing. The exterior sound vents (e.g. 805) and/or sound holes (e.g. 803, 807) can also contribute to reduction of background and wind noise while allowing at least some desirable sound to enter the clamshell enclosure (800) to be transmitted to the microphone. In one embodiment of the invention, the microphone casing placed inside the clamshell enclosure (800) is operatively connected to a first electrical cord (801) and a second electrical cord (809).

In addition, the clamshell enclosure (800) may optionally incorporate one or more channels as electrical cord pathways between a microphone casing encapsulated in the clamshell enclosure (800) and another object (e.g. electronic device, earphones, and etc.), as previously shown in FIG. 2.

FIG. 9 shows a detailed half-open-state view of a clamshell enclosure (900) with interior foam (907) and exterior sound vents (e.g. 905) and/or sound holes (e.g. 901, 903) in accordance with an embodiment of the present invention. In one embodiment of the invention, the clamshell enclosure (900) has a hot-dog shape, with mostly or entirely straight sides. In one embodiment of the invention, a top piece and a bottom piece of the clamshell enclosure (900) is held together by a hinge. In one embodiment of the invention, the hinge used for holding the top piece and the bottom piece of the clamshell enclosure (900) is a spring hinge with a defined secure close position and a defined secure open position. In another embodiment of the invention, the top piece and the bottom piece of the clamshell enclosure (900) is held together by a plastic membrane.

Furthermore, in one embodiment of the invention, the clamshell enclosure (900) has interior foam (907) in an inner surface (909) of the clamshell enclosure (900) to reduce background and wind noise entering a microphone contained by the microphone casing. The exterior sound vents (e.g. 905) and/or sound holes (e.g. 901, 903) can also contribute to reduction of background and wind noise while allowing at least some desirable sound to enter the clamshell enclosure (900) to be transmitted to the microphone. In one embodiment of the invention, the clamshell enclosure (900) is made out of flexible or malleable materials such as non-rigid plastic.

In addition, the clamshell enclosure (900) may optionally incorporate one or more channels as electrical cord pathways between a microphone casing encapsulated in the clamshell enclosure (900) and another object (e.g. electronic device, earphones, and etc.), as previously shown in FIG. 2.

A novel clamshell enclosure encapsulating a microphone has been described as an apparatus for reducing background and wind noise. One advantage of the present invention is achieving more effective reduction of background and wind noise using the novel clamshell enclosure, compared to existing microphone windscreens used in typical headphones. Another advantage of the present invention is the ease of encapsulation of a microphone casing using the novel clamshell enclosure, especially when the microphone casing has more than one side of electrical connections. Yet another advantage of the present invention is accommodating a button-press feature (e.g. "Connect Call" or "Disconnect Call" button on a microphone) by optionally using a malleable material for the novel clamshell enclosure. Yet another advantage of the present invention is fashion accessory potential of a clamshell enclosure, wherein the clamshell enclosure can use embroidered or printed graphics, possibly in combination with a distinct shape of the clamshell closure, to make a user's fashion statement or endorsement (e.g. a sports team, a brand logo, a political party, a national flag, and etc.)

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An apparatus for reducing background and wind noise to a microphone contained in a microphone casing, the apparatus comprising:

a clamshell enclosure with a hinge or a plastic membrane on a first side of the clamshell enclosure, wherein the clamshell enclosure is made of a flexible material to enable a squeezing motion for the microphone casing placed inside the clamshell enclosure, and wherein the squeezing motion acts as a button press, and wherein the clamshell enclosure is configured to open and/or close to encapsulate the microphone casing;

a first channel on the clamshell enclosure for accommodating a first electrical cord operatively connected to the microphone casing, wherein the microphone casing is placed inside the clamshell enclosure; and a second channel on the clamshell enclosure for accommodating a second electrical cord operatively connected to the microphone casing, wherein the microphone casing is placed inside the clamshell enclosure.

2. The apparatus of claim 1, further comprising a plurality of sound vents/and or sound holes on the clamshell enclosure.

3. The apparatus of claim 1, wherein the first electrical cord operatively connected to the microphone casing is connected to an earphone.

4. The apparatus of claim 1, wherein the second electrical cord operatively connected to the microphone casing is connected to a voice communication-capable electronic device.

5. The apparatus of claim 1, wherein the hinge is a spring hinge configured to provide a secure open or a secure close position.

6. The apparatus of claim 1, further comprising a windscreen sponge foam surrounding at least a portion of an interior surface of the clamshell enclosure.

7. The apparatus of claim 6, wherein the windscreen sponge foam is made of polyurethane.

8. The apparatus of claim 1, wherein the clamshell enclosure is made of a windscreen sponge foam.

9. The apparatus of claim 8, wherein the windscreen sponge foam is made of polyurethane.

10. An apparatus for reducing background and wind noise to a microphone contained in a microphone casing, the apparatus comprising:

a clamshell enclosure made of a flexible material to enable a squeezing motion for the microphone casing placed inside the clamshell enclosure, wherein the squeezing motion acts as a button press;

a top piece of the clamshell enclosure with a plastic membrane attached to a first side of the top piece of the clamshell enclosure;

a bottom piece of the clamshell enclosure with the plastic membrane attached to a first side of the bottom piece of the clamshell enclosure, wherein the clamshell enclosure is configured to open and/or close to encapsulate the microphone casing;

a first channel on the clamshell enclosure for accommodating a first electrical cord operatively connected to the microphone casing, wherein the microphone casing is placed inside the clamshell enclosure;

a second channel on the clamshell enclosure for accommodating a second electrical cord operatively connected to the microphone casing, wherein the microphone casing is placed inside the clamshell enclosure; and a snap-fit locking mechanism between the top piece and the bottom piece of the clamshell enclosure.

11. The apparatus of claim 10, wherein the snap-fit locking mechanism has a female guide piece on the top piece or the bottom piece of the clamshell enclosure and a male guide piece on the bottom piece or the top piece of the clamshell enclosure.

12. The apparatus of claim 10, wherein the snap-fit locking mechanism comprises a closure latch on the top piece or the bottom piece of the clamshell enclosure and a closure latch hook on the bottom piece or the top piece of the clamshell enclosure.

13. The apparatus of claim 10, further comprising a plurality of sound vents and/or sound holes on the clamshell enclosure.

14. The apparatus of claim 10, further comprising a windscreen sponge foam surrounding at least a portion of an interior surface of the clamshell enclosure.

15. The apparatus of claim 10, wherein the clamshell enclosure is made of a windscreen sponge foam.

16. The apparatus of claim 10, wherein the first electrical cord operatively connected to the microphone casing is connected to an earphone.

17. The apparatus of claim 10, wherein the second electrical cord operatively connected to the microphone casing is connected to a voice communication-capable electronic device.

18. An apparatus for reducing background and wind noise to a microphone contained in a microphone casing, the apparatus comprising:

a clamshell enclosure made of a flexible material to enable a squeezing motion for the microphone casing placed inside the clamshell enclosure, wherein the squeezing motion acts as a button press;

a top piece of the clamshell enclosure, wherein a first side of the top piece of the clamshell enclosure is mostly or entirely straight;

a bottom piece of the clamshell enclosure, wherein a first side of the bottom piece of the clamshell enclosure is mostly or entirely straight and wherein the clamshell enclosure is configured to open and/or close to encapsulate the microphone casing;

a hinge or a plastic membrane connecting a second side of the top piece of the clamshell enclosure and a second side of the bottom piece of the clamshell enclosure;

a first electrical cord operatively connected to a top portion of the microphone casing, wherein the microphone casing is placed inside the clamshell enclosure; and a second electrical cord operatively connected to a bottom portion of the microphone casing, wherein the microphone casing is placed inside the clamshell enclosure.

* * * * *